United States Patent [19]

Aslund

[11] 4,050,143

[45] Sept. 27, 1977

[54] METHOD OF PRODUCING DENSE METAL TUBES OR THE LIKE

[75] Inventor: Christer Aslund, Torshalla, Sweden

[73] Assignee: Granges NYBY AB, Sweden

[21] Appl. No.: 569,264

[22] Filed: Apr. 18, 1975

[30] Foreign Application Priority Data

Apr. 19, 1974 Germany ..... 2419014

[51] Int. Cl.[2] ..... B22F 3/24

[52] U.S. Cl. ..... 29/420.5; 29/DIG. 31; 75/214; 75/226

[58] Field of Search ..... 29/DIG. 47, 420.5, 420, 29/DIG. 31, 180 E, 187, 192 R; 75/226, 214

[56] References Cited

U.S. PATENT DOCUMENTS

| | | | |
|---|---|---|---|
| 2,885,287 | 5/1959 | Larson | 75/226 |
| 3,042,594 | 7/1962 | Hauth et al. | 29/420 |
| 3,328,139 | 6/1967 | Hodge et al. | 75/214 X |
| 3,390,985 | 7/1968 | Croeni et al. | 29/420.5 X |
| 3,450,528 | 6/1969 | Thompson | 75/226 X |
| 3,724,050 | 4/1973 | Velten et al. | 75/214 X |
| 3,728,111 | 4/1973 | Stromblad et al. | 75/226 X |
| 3,744,993 | 7/1973 | Matt et al. | 75/213 |
| 3,823,463 | 7/1974 | Weaver et al. | 29/420.5 X |
| 3,824,097 | 7/1974 | Smythe et al. | 75/226 |

*Primary Examiner*—Victor A. DiPalma
*Attorney, Agent, or Firm*—Craig & Antonelli

[57] ABSTRACT

A method and a capsule and a blank for producing tubes, bars or similar profiled elongated dense metal objects, preferably in stainless steel qualities, by single or multi-stage extrusion of capsules which are filled with powder of metals or metal alloys or mixtures thereof or with mixtures of powder of metals and/or metal alloys with ceramic powder and sealed and which are adapted in their form to the desired object or intermediate product, as starting material a powder being used which consists at least predominantly of substantially spherical grains and the capsule filled with said powder and sealed being compressed by means of cold-isostatic pressure acting all round until the density of the powder reaches at least 80% of the theoretical density.

17 Claims, 1 Drawing Figure

METHOD OF PRODUCING DENSE METAL TUBES OR THE LIKE

Figure 1:
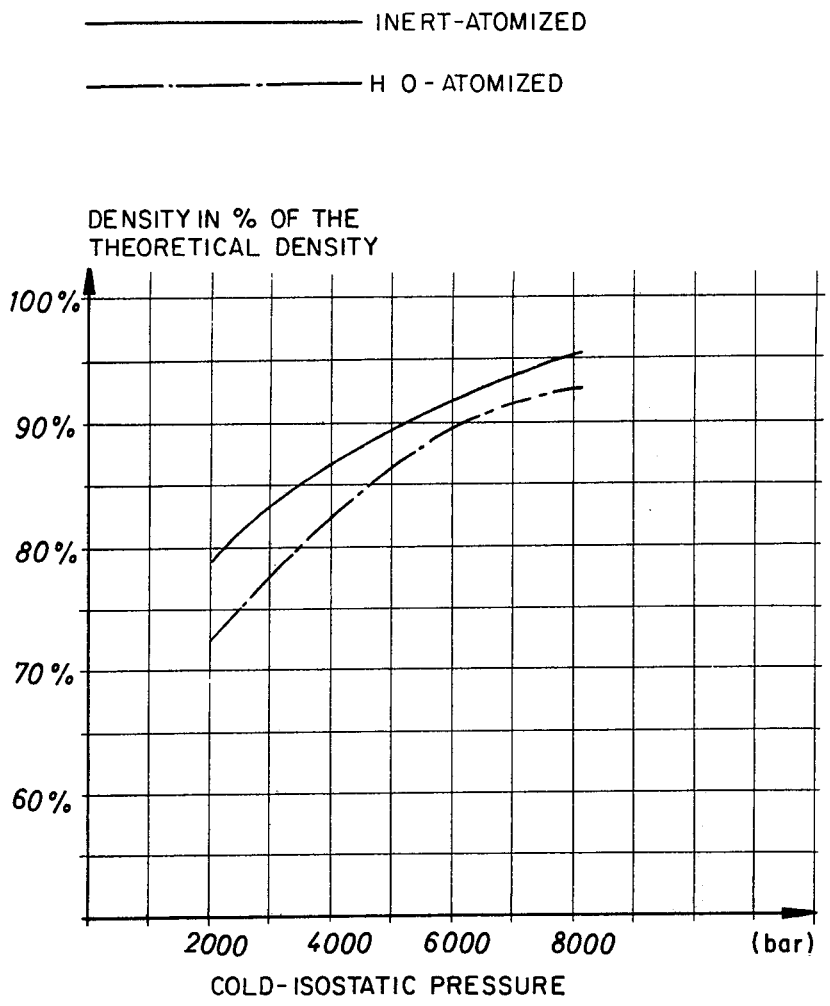

The present invention relates to a method of producing tubes, bars or similar profiled elongated dense metal objects, preferably in stainless steel qualities, by single or multi-stage extrusion of capsules which are filled with powder of metals or metal alloys or mixtures thereof or with mixtures of powder of metals and/or metal alloys with ceramic powder and sealed and which are adapted in their form to the desired object or intermediate product.

In a known method metal powder is filled directly into the container of an extrusion press and extruded in a single-stage method directly to form the desired final product or in a multi-stage method via intermediate products in two or more steps to form the final product.

In a modification of this method, a blank is made which can be inserted in the container of the press and extruded. The blank may be made in various ways:

a. the powder is cold-pressed and sintered b. the powder is hot-pressed c. the powder is filled in a capsule which is sealed.

The present invention relates to the production of tubes, applying basically the latter method under (c), i.e., encapsulating the powder with subsequent single or multi-stage extrusion of the capsule filled with the powder.

For economic and production technique reasons it is necessary for the capsule material to be as thin as possible. This involves the problem that the capsule has a tendency to wrinkle or form creases during the extrusion operation. In the production of elongated objects such as tubes or the like the ratio of the length to the diameter of the capsule must be greater than one. This further increases the tendency to crease or fold of the capsule, especially when the capsule wall is thin.

Various proposals have been made for solving this problem but so far none has provided an economically and technically satisfactory solution. Thus, for example, it has been proposed to cold-press the capsule after introducing the powder and sealing the capsule. However, with this technique, because of the frictional forces between the capsule and the mechanical tool used for the cold-pressing the results are not satisfactory, particularly when the length of the capsule with respect to its diameter has a ratio of more than one. The frictional forces also unacceptably reduce the total reduction which can be achieved and cause it to vary over the length of the blank which inter alia leads to unfavorable conditions on heating the blank prior to extrusion.

The present invention adopts a completely different procedure for solving the aforementioned problem.

The present invention is based on the problem of providing a method for the production of tubes, rods, profile sections or similar elongated objects consisting preferably of stainless material, creasing or wrinkling of the capsule being avoided.

According to the method of the invention this problem is solved in that as starting material powder is used which consists at least predominantly of substantially spherical grains and the capsule filled with said powder and sealed compressed by means of cold-isostatic pressure acting all round until the density of the powder reaches at least 80% of the theoretical density, and that the blank thus obtained is heated and extruded in one or more stages to form the desired object. The method according to the invention has the advantage that the capsule does not form any creases on extrusion.

In the method according to the invention thin-walled capsules of preferably highly ductile material, for example carbon steel or nickel, may be used.

According to the invention capsules are preferably used whose wall thickness is at the most about 5% of the external diameter of the capsule, preferably however less than 3%, in particular less than 1% of the outer diameter of the capsule.

The wall thickness of the capsules is preferably between 0.1 and 5 mm, advantageously between about 2.0 and 3 mm.

It is advantageous to use a powder having a grain size or diameter of less than 1 mm, preferably less than 0.6 mm (600 $\mu$).

Preferably, the density of the powder filled into the capsule is increased by vibrating and/or ultrasonic oscillations to about 60 to 70% of the theoretical density, i.e., the density of the solid material, before the capsule is subjected to the isostatic pressure.

According to the invention the capsule filled with the powder and sealed is subjected to an isostatic pressure of at least 1500 bar (about 21,800 psi), preferably at least 5000 bar (about 72,500 psi).

The method according to the invention is intended primarily for use with stainless material. It may of course be used for other material of metallic type or mixtures of for example metallic and ceramic powder.

To obtain a satisfactory product, it is further important for the powder to have a low content of oxygen and this is achieved by using inert-gas atomized spherical powder.

Due to the spherical form of the powder grains and by the vibrating of a powder filling a very high apparent density is achieved, which is an extremely important property for the invention and which distinguishes the spherical powder from irregular powder forms.

The spherical powder is introduced into capsules of preferably highly ductile material of suitable shape for the desired intermediate or final product and possibly vibrated to give a density of 60 to 70% of the theoretical density, i.e., the density of the solid material. If compound objects are to be made, various metals are used in powder form. The powder is introduced into a capsule which is divided by one or more separating walls. Said walls may be either of plastic, steel or a similar material. After filling and vibrating the powder the walls are removed. The powder is sealed in the capsule of highly ductile material with or without evacuation. Thereafter, the capsule is subjected with the enclosed powder to a cold-isostatic pressure of at least 1500 bar (about 21,800 psi), but preferably higher pressures, for example 5000 bar (about 72,500 psi), the density of 60 to 70% being increased to 80 to 90% of the theoretical density, depending on the pressure used. Because the starting density of the powder is so high the capsule does not crease during the cold-pressing and the extrusion in spite of the fact that the ratio of the length to the diameter is greater than one, for example four, and that a thin capsule is used which is very important for economic reasons, as already mentioned. It has been found that the ratio between the outer diameter of the capsule and the capsule wall thickness is critical. According to the present invention, this ratio is to be a maximum of 5%, preferably below 3% and advantageously below 1%. The wall thickness of the capsule is preferably between about 1.0 and 5 mm, especially about 0.2 and 2 mm. It is pointed out that the high percentages are to be used with relatively small diameters and conversely the low percentages with relatively high diameters.

Due to the pressure all round in the cold-isostatic compression the blank is given a substantially uniform density over its entire length. Because the density increases greatly, it is also easier to heat the blank in a short time in an induction furnace or in similar manner.

After the heating the capsule is extruded in one or more stages. The capsule material is drawn out as this is done to a very thin layer or skin. On emergence from the extrusion press the layer or skin oxidizes in the air and partially peels off. The residues of the capsule material are removed in the subsequent annealing, pickling in nitric acid or by sand blasting. The tube can then be further processed in the normal manner.

The tubes, rods, or similarly profiled elongated objects made by the method according to the invention have a surprisingly uniform structure and surprisingly consistent physical and chemical properties. In particular, the fluctuations regarding the hardness and chemical resistance of the products obtained are substantially smaller. This applies also to compound articles made by the method of the invention. These properties of the tubes and the like made according to the invention are due to the fact that the segregations which always occur in conventional production, in particular in streak form, cannot arise.

If desired the capsule may consist of a material given a high-quality surface finish by providing the extruded tubes or the like with a permanent coating of the capsule material. The thickness of the surface coating or plating may be predetermined by suitable choice of the wall thickness of the capsule. Highly ductile materials are particularly suitable for making such surface layers.

The invention will be explained in detail hereinafter with the aid of examples.

EXAMPLE 1

Argon-atomized stainless powder of spherical grain form and a grain size of less than 600 $\mu$, having a low total oxygen content, was placed in a tubular capsule and vibrated. The capsule was constructed as annular body having an external diameter of about 140 mm and consisted of a steel of low carbon content. The wall thickness was 3 mm and the length 550 mm. The annular capsule comprised a central inner continuous tubular section having about the same wall thickness and the same carbon steel quality as the outer casing of the capsule. The low carbon content of the capsule material was necessary to prevent carburization of the powder during the heating and extrusion.

The capsule was evacuated and sealed in known manner. Thereafter, the capsule was subjected to a cold-isostatic pressure by lowering it in a liquid (water in the present case) and subjecting it to an all round pressure of 5000 bar (about 72,500 psi). The capsule shrank and the density of the powder rose from about 68 to about 90% without the capsule material creasing.

To facilitate the explanation, an identical capsule to that in example 1 was for comparison subjected to a normal cold pressing instead of a cold-isostatic pressure, i.e., compacted in a mechanical press. A density of the powder of 75% of the theoretical density was achieved although the pressure used was twice as high as that in example 1.

The blank made by cold-isostatic presssure was then heated in a preheating furnace to 900° C and finally to 1240° C in an induction coil, whereafter the blank was extruded to form a seamless tube. The tube was cooled in the water bath and the capsule material removed in a nitric acid bath. The tube was faultless.

The blank made for comparison in a mechanical press was heated and extruded in the same manner. After removing the capsule material, the resulting tube was useless. The folds and creases produced on pressing had given rise to cracks and other material flaws which rendered the tube useless.

EXAMPLE 2

In another case a compound tube was made in the following manner:

In a sheet metal capsule corresponding to example 1 having a continuous inner central tube, a thin-walled tube was placed half-way between the external and inner wall of the capsule. In the outer intermediate space, whilst simultaneously vibrating, a spherical powder of a 25% chromium steel was placed which had high contents of silicon and aluminium. The grain size was less than 600 $\mu$. It is emphasized that a blank of this quality is exceedingly difficult to make with conventional methods, i.e., smelting metallurgy. The material is particularly suitable for powder metallurgical production. It is known that products of this quality are of very great industrial significance.

Spherical stainless powder of a chromium-nickel steel (18% Cr and 8% Ni) having a grain size of less than 600 $\mu$ was placed in the inner intermediate space with simultaneous vibration. After removing the intermediate wall and evacuating and sealing the capsule the latter was exposed to a cold-isostatic pressure of 5000 bar (about 72,500 psi). Thereafter, the blank was heated and extruded to form a seamless tube as described in example 1. The capsule material was also removed in a nitric acid bath. A structural investigation of the compound tube showed that the structure was completely dense and completely uniform. There was a total bond in the junction region of the two materials, i.e., without flaws. It is emphasized that the faultless production of a compound tube is practically impossible with hitherto known methods.

EXAMPLE 3

The same powder and capsule material as in example 1 was not subjected to an isostatic compression but heated directly to 1200° and extruded to a finished tube. The tube had pronouned surface flaws due to wrinkling of the capsule, itself due to the low starting density of the powder body. This test thus shows that a compacting of the blank prior to the extrusion is necessary to avoid the known phenomenon of creasing of the capsule and thus to avoid the occurrence of surface flaws.

EXAMPLE 4

The same powder and the same capsule material as in example 1 was subjected to an isostatic pressure of 2000 bar (about 29,000 psi); the capsule shrank without wrinkling. The density of the powder was increased to 82% of the theoretical density.

The blank was heated and extruded in the manner described above. The tube obtained was faultless and did not exhibit any creasing or wrinkling.

The test proves that a cold-isostatic compacting of up to 80% is sufficient to give a flawless product.

EXAMPLE 5

Of eight capsules, four were filled with stainless steel powder of irregular form (powder atomized in water) and four with regular spherical grain form (powder atomized in argon or another inert gas). The capsules were subjected to a cold-isostatic pressure of 2000 (about 29,000 psi), 4000 (about 58,000 psi), 6000 (about 87,000 psi) and 8000 (about 116,000 psi) bar which led to densities as illustrated in FIG. 1.

The four capsules which had been filled with powder of irregular form exhibited pronounced wrinkling and creasing at the surface. The capsule with spherical powder, in contrast, did not exhibit any flaws. The tests show that it is essential to use spherical powder, which also gives a high apparent density, if wrinkling (creasing) and other flaws are to be avoided when using cold-isostatic pressure for achieving densities above 80%.

The diagram illustrates the ratio between the cold-isostatic pressure and the densities achieved on compressing inert-atomized powder (full line) and water-atomized powder (dot-dash line) and the fact that densities above 80% were achieved with considerably less pressure with inert-atomized powder.

What I claim is:

1. In a method for producing an elongated dense metal object in which metal powder is sealed in a metal container, the metal container with the metal powder therein is partially compressed in a first compression step and the partially compressed metal container so formed is extruded at elevated temperature in a second compression step, the improvement wherein (1) the metal particles of said metal powder are substantially spherical, (2) said container is formed from a ductile metal, (3) the wall thickness of said container is at most 5% of the outer diameter of said container, (4) said metal contaner is subjected to cold-isostatic pressure acting on all surfaces of said container during said first compression step, and (5) said metal container is compressed until the density of the metal powder therein reaches at least 80% of the theoretical density during said first compression step.

2. A method according to claim 1, wherein the wall thickness of said container is less than 3% of the outer diameter of said container.

3. A method according to claim 1, wherein the wall thickness of said container is between about 0.1 to 5 mm.

4. A method according to claim 1, wherein said metal powder has a grain size or diameter of less than 1 mm.

5. A method according to claim 1, wherein said container is subjected to an isostatic pressure of at least 1500 bar during said first compression step.

6. A method according to claim 1, wherein said container is filled with an inert gas prior to sealing.

7. A method according to claim 1, wherein said first compression step is continued until the density of the metal powder in said container is between 80% and 90% of the theoretical density.

8. A method according to claim 2, wherein the wall thickness of said container is less than 1% of the outer diameter of said container.

9. A method according to claim 3, wherein the wall thickness of said container is between 0.2 and 3 mm.

10. A method according to claim 4, wherein said metal powder has a grain size of less than 0.6 mm.

11. A method according to claim 1, wherein said container is vibrated as said metal powder is filled therein whereby the density of the metal powder in said metal container is between 60 to 70% of the theoretical density prior to said first compression step.

12. A method according to claim 11, wherein said container is vibrated ultrasonically.

13. A method according to claim 5, wherein said container is subjected to isostatic pressure of at least 5000 bar during said first compression step.

14. A method according to claim 1, wherein said container includes at least one concentric partition dividing the interior of said container into at least two regions, each of said regions being filled with metal powder having a different composition from the metal powder filling the other regions.

15. A method according to claim 1, wherein said container is evacuated prior to sealing.

16. A method according to claim 1, wherein said metal powder is formed from stainless steel.

17. A method according to claim 16, wherein the length to diameter ratio of said elongated dense metal object is greater than 1.

* * * * *